US009552793B2

(12) United States Patent
Chun et al.

(10) Patent No.: US 9,552,793 B2
(45) Date of Patent: Jan. 24, 2017

(54) DATA PROCESSING DEVICE, DISPLAY DEVICE HAVING THE SAME, AND GAMUT MAPPING METHOD

(71) Applicant: Samsung Display Co., Ltd., Yongin, Gyeonggi-Do (KR)

(72) Inventors: Byung Ki Chun, Seoul (KR); Dongwook Yang, Seoul (KR); Yongseok Choi, Daejeon (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 192 days.

(21) Appl. No.: 14/167,157

(22) Filed: Jan. 29, 2014

(65) Prior Publication Data

US 2015/0062145 A1 Mar. 5, 2015

(30) Foreign Application Priority Data

Aug. 28, 2013 (KR) ..... 10-2013-0102597

(51) Int. Cl.
*G09G 5/02* (2006.01)
*G09G 3/20* (2006.01)

(52) U.S. Cl.
CPC ..... *G09G 5/026* (2013.01); *G09G 3/2003* (2013.01); *G09G 3/2074* (2013.01); *G09G 2300/0452* (2013.01); *G09G 2320/0673* (2013.01); *G09G 2340/06* (2013.01)

(58) Field of Classification Search
CPC ..... G09G 2340/06; G09G 2320/0673
See application file for complete search history.

(56) References Cited

U.S. PATENT DOCUMENTS 6,400,843 B1 * 6/2002 Shu ..... H04N 1/6058 345/590
7,486,417 B2 2/2009 Baek
8,026,953 B2 9/2011 Lammers et al.
8,035,655 B2 10/2011 Kim et al.
8,248,430 B2 8/2012 Hekstra et al.
8,289,266 B2 10/2012 Roth et al.
8,295,594 B2 10/2012 Brown et al.
(Continued)

FOREIGN PATENT DOCUMENTS

KR 1020110050172 A 5/2011
KR 1020130010444 A 1/2013

*Primary Examiner* — Jacinta M Crawford
*Assistant Examiner* — Jonathan M Cofino
(74) *Attorney, Agent, or Firm* — Cantor Colburn LLP

(57) ABSTRACT

A data processing device includes a first reference value generator which generates a first reference value corresponding to a ratio of a chromatic color using image signals or first image signals obtained by gamma-compensating the image signals, a white generator which generates a white image signal and second image signals using the first image signals and a second reference value corresponding to an amount of a white data in use, a third reference value generator which generates a third reference value using a first color coordinate corresponding to a color coordinate of the second image signals, a second color coordinate corresponding to a color coordinate of the white image signal, the first reference value, and the second reference value, and a gamut mapper which maps the second image signals to a color coordinate corresponding to the third reference value to generate third image signals.

16 Claims, 14 Drawing Sheets

(56) References Cited

U.S. PATENT DOCUMENTS

| | | | | |
|---|---|---|---|---|
| 2003/0035673 | A1* | 2/2003 | Yamakawa | H04N 1/40062 400/76 |
| 2004/0263456 | A1* | 12/2004 | Miyachi | G09G 3/3607 345/88 |
| 2005/0030305 | A1* | 2/2005 | Brown | G02B 26/0841 345/207 |
| 2006/0284805 | A1* | 12/2006 | Baek | G09G 3/3607 345/88 |
| 2008/0239410 | A1* | 10/2008 | Hashii | H04N 1/6072 358/462 |
| 2010/0020242 | A1 | 1/2010 | Lammers et al. | |
| 2010/0033494 | A1* | 2/2010 | Klompenhouwer | G06T 5/004 345/590 |
| 2011/0001853 | A1* | 1/2011 | Sato | H04N 5/3675 348/246 |
| 2011/0012512 | A1* | 1/2011 | Young | F21K 9/00 315/117 |

* cited by examiner

DATA PROCESSING DEVICE, DISPLAY DEVICE HAVING THE SAME, AND GAMUT MAPPING METHOD

This application claims priority to Korean Patent Application No. 10-2013-0102597, filed on Aug. 28, 2013, and all the benefits accruing therefrom under 35 U.S.C. §119, the content of which in its entirety is herein incorporated by reference.

BACKGROUND

1. Field

The disclosure relates to a display device. More particularly, the disclosure relates to a data processing device that performs a gamut mapping, a display device including the data processing device, and a gamut mapping method.

2. Description of the Related Art

In recent years, various display devices, such as a liquid crystal display device, an organic light emitting display device, an electrowetting display device, a plasma display panel device, an electrophoretic display device, etc., have been developed. The display devices are employed in various fields for use in electronic devices, e.g., a smart phone, a digital camera, a notebook computer, a navigation system, etc.

In general, the display device receives an image signal from an external source. To display an image, the display device converts a data format of the image signal to a data format suitable for the display device.

SUMMARY

The disclosure provides a data processing device that normally performs a gamut mapping operation based on a ratio between an amount of a white color image signal in use and a chromatic color, a display device including the data processing device, and a gamut mapping method.

An exemplary embodiment of the invention provides a data processing device including a first reference value generator which generates a first reference value corresponding to a ratio of a chromatic color using image signals or first image signals obtained by gamma-compensating the image signals, a white generator which generates a white image signal and second image signals using the first image signals and a second reference value corresponding to an amount of a white data in use, a third reference value generator which generates a third reference value using a first color coordinate, a second color coordinate, the first reference value and the second reference value, where the first color coordinate corresponds to a color coordinate of the second image signals, and the second color coordinate corresponds to a color coordinate of the white image signal, and a gamut mapper which maps the second image signals to a color coordinate corresponding to the third reference value to generate third image signals.

In an exemplary embodiment, the data processing device further includes a gamma compensator which gamma-compensates the image signals and outputs the gamma-compensated image signals as the first image signals, and a reverse gamma compensator which performs a reverse gamma compensation on the third image signals and the white image signal and outputs the reverse gamma compensated third and white image signals.

In an exemplary embodiment, the first reference value is set by dividing a minimum value among data values of the image signals by a maximum value among the data values of the image signals or by dividing a minimum value among data values of the first image signals by a maximum value among the data values of the first image signals.

In an exemplary embodiment, the second reference value is set to a value between 0 and 1 and the white image signal is set by multiplying a minimum value among data values of the first image signals by the second reference value.

In an exemplary embodiment, data values of the second image signals are set by subtracting a data value of the white image signal from the data values of the first image signals.

In an exemplary embodiment, the third reference value is set by adding the first color coordinate to a value, which is obtained by multiplying the first and second reference values by a value, which is obtained by subtracting the second color coordinate from the first color coordinate.

Another exemplary embodiment of the invention provides a display device including a data processing device which generates a white image signal using image signals input thereto and performs a gamut mapping on the image signals, a display panel which includes a plurality of pixels, and a driving circuit which drives the pixels using the white image signal and the gamut-mapped image signals. In such an embodiment, the data processing device includes a first reference value generator which generates a first reference value corresponding to a ratio of a chromatic color using the image signals or first image signals obtained by gamma-compensating the image signals, a white generator which generates the white image signal and second image signals using the first image signals and a second reference value corresponding to an amount of a white data in use, a third reference value generator which generates a third reference value using a first color coordinate, a second color coordinate, the first reference value and the second reference value, where the first color coordinate corresponds to a color coordinate of the second image signals, and the second color coordinate corresponds to a color coordinate of the white image signal, and a gamut mapper which maps the second image signals to a color coordinate corresponding to the third reference value to generate the gamut-mapped image signals.

Another exemplary embodiment of the invention provides a gamut mapping method including calculating a first reference value corresponding to a ratio of a chromatic color using image signals or first image signals obtained by gamma-compensating for the image signals, generating a white image signal and second image signals using the first image signals and a second reference value corresponding to an amount of a white data in use, generating a third reference value using a first color coordinate corresponding to a color coordinate of the second image signals, a second color coordinate corresponding to a color coordinate of the white image signal, the first reference value, and the second reference value, and mapping the second image signals to a color coordinate corresponding to the third reference value to generate third image signals.

According to exemplary embodiments described herein, the gamut mapping operation may be normally performed based on the amount of the white image signal in use and the ratio of the chromatic color.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
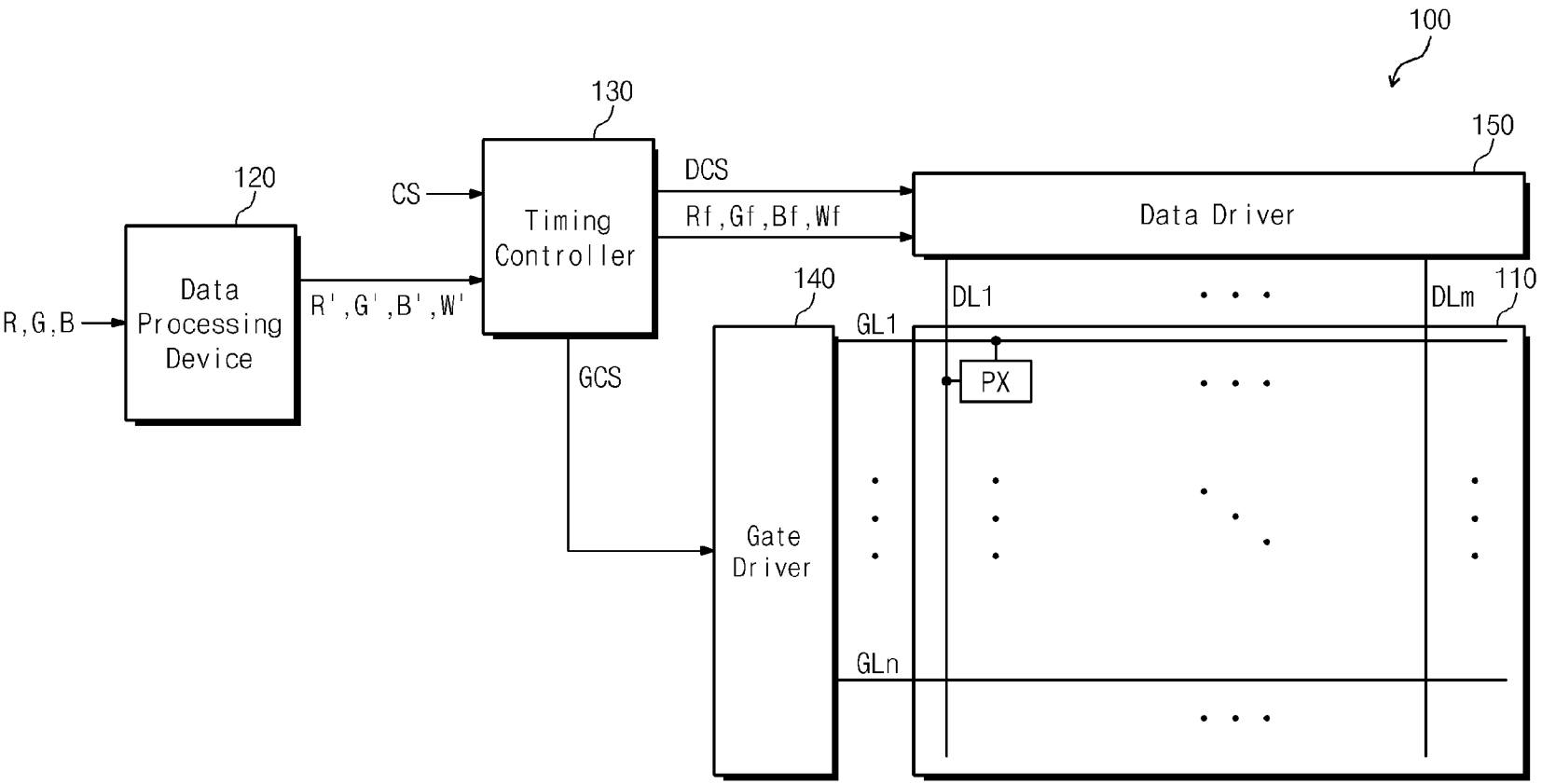
FIG. 1 is a block diagram showing an exemplary embodiment of a display device, according to the invention.

The invention will be described more fully hereinafter with reference to the accompanying drawings, in which various embodiments are shown. The invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings herein.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

The terminology used herein is for the purpose of describing particular embodiments only and is not intended to be limiting. As used herein, the singular forms, "a", "an" and "the" are intended to include the plural forms as well, unless the context clearly indicates otherwise. It will be further understood that the terms "comprises" and/or "comprising," or "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the invention will be described in detail with reference to the accompanying drawings.

Figure 2A:
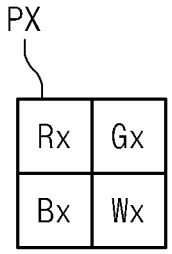
FIGS. 2A and 2B are views showing various arrangements of pixels shown in FIG. 1.
Figure 2B:
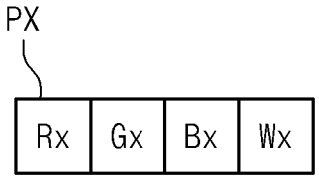

FIG. 1 is a block diagram showing an exemplary embodiment of a display device, according to the invention, and FIGS. 2A and 2B are views showing various arrangements of pixels shown in FIG. 1.

Referring to FIGS. 1, 2A and 2B, an exemplary embodiment of a display device 100 includes a display panel 110, a data processing device 120, a timing controller 130, a gate driver 140 and a data driver 150.

The display panel 110 includes a plurality of pixels PX, a plurality of gate lines GL1 to GLn and a plurality of data lines DL1 to DLm. In FIG. 1, one pixel is shown for convenience of illustration. In such an embodiment, the pixels PX may be arranged substantially in a matrix form.

As shown in FIGS. 2A and 2B, the pixels PX may include a red pixel Rx, a green pixel Gx, a blue pixel Bx and a white pixel Wx. The red, green, blue and white pixels Rx, Gx, Bx and Wx display red, green, blue and white colors, respectively.

In an exemplary embodiment, the red, green, blue and white pixels Rx, Gx, Bx and Wx, which are arranged in two rows by two columns as shown in FIG. 2A, may be repeatedly arranged in row and column directions. In an alternative exemplary embodiment, the red, green, blue and white pixels Rx, Gx, Bx and Wx, which are arranged in the row direction as shown in FIG. 2B, may be repeatedly arranged in row and column directions. However, the arrangement of the red, green, blue and white pixels Rx, Gx, Bx and Wx are not be limited thereto or thereby.

The gate lines GL1 to GLn are insulated from the data lines DL1 to DLm while crossing the data lines DL1 to DLm. Each of the pixels PX is connected to a corresponding gate line of the gate lines GL1 to GLn and a corresponding data line of the data lines DL1 to DLm.

The gate lines GL1 to GLn are connected to the gate driver 140 to sequentially receive gate signals from the gate driver 140. The data lines DL1 to DLm are connected to the data driver 150 to receive data voltages in analog form.

The data processing device 120 receives image signals R, G and B from an external source, e.g., a system board. The data processing device 120 generates a white image signal W' using the image signals R, G and B, and the data processing device 120 maps the image signals R, G and B from a predetermined color reproduction area to another color reproduction area (hereinafter, referred to as target color reproduction area). This mapping operation is called a gamut mapping, which will be described in detail later.

The data processing device 120 provides the image signals R', G' and B', which are gamut-mapped, and the white image signal W', which are generated therein (also collectively referred to as processed image signals R', G', B' and W'), to the timing controller 130. In an exemplary embodiment, as shown in FIG. 1, the data processing device 120 is configured to be separated from the timing controller 130. In an alternative exemplary embodiment, the data processing device 120 may be integrated in the timing controller 130.

The timing controller 130 receives a control signal CS from the system board, and the timing controller 130 receives the processed image signals R', G', B' and W' from the data processing device 120. Although not shown in FIG. 1, the control signal CS may include a horizontal synchronization signal, a vertical synchronization signal, a main clock signal and a data enable signal.

The timing controller 130 generates converted image signals Rf, Gf, Bf and Wf by converting a data format of the processed image signals R', G', B' and W' to a data format corresponding to an interface between the data driver 150 and the timing controller 130. The timing controller 130 provides the converted image signals Rf, Gf, Bf and Wf, which are obtained by converting the data format of the processed image signals R', G', B' and W', to the data driver 150.

The timing controller 130 generates a gate control signal GCS and a data control signal DCS in response to the control signal CS. The gate control signal GCS controls an operation timing of the gate driver 140, and the data control signal DCS controls an operation timing of the data driver 150.

Although not shown in FIG. 1, the data control signal DCS may include a latch signal, a horizontal start signal, a polarity control signal and a clock signal, and the gate control signal GCS may include a vertical start signal, a gate clock signal and an output enable signal. The timing controller 130 applies the gate control signal GCS to the gate driver 140 and applies the data control signal DCS to the data driver 150.

The gate driver 140 outputs the gate signals in response to the gate control signal GCS. The gate signals are sequentially applied to the pixels PX through the gate lines GL1 to GLn on a row-by-row basis. In such an embodiment, the pixels PX may be driven one row at a time. The gate driver 140 may be disposed, e.g., mounted, on a left or right portion of the display panel 110 in the form of amorphous silicon thin film transistor gate driver circuit.

The data driver 150 converts the converted image signals Rf, Gf, Bf and Wf to analog data voltages in response to the data control signal DCS and outputs the analog data voltages. In an exemplary embodiment, the data driver 150 may convert the converted image signals Rf, Gf, Bf and Wf to gamma-compensated data voltages using gamma voltages provided from a gamma voltage generator (not shown) and output the gamma-compensated data voltages to the data lines DL1 to DLm.

In an exemplary embodiment, an input image signal having a nonlinear gray-scale display characteristic may be converted to an image signal having a linear gray-scale input-output characteristic by the gamma compensation. Therefore, the gamma-compensated data voltages have the linear characteristic and are applied to the pixels. The data voltages are applied to the pixels PX through the data lines DL1 to DLm.

In an exemplary embodiment, the data driver 150 may be provided as a data driving integrated circuit and attached to the display panel 110 in a tape carrier package. In an exemplary embodiment, the data driver 150 may be directly mounted on a non-display area of the display panel 110 after being provided as the data driving integrated circuit.

The timing controller 130, the gate driver 140 and the data driver 150 define a driving circuit part to drive the pixels PX of the display panel 110. In such an embodiment, the driving circuit part is configured to include the timing controller 130, the gate driver 140 and the data driver 150.

The pixels PX receive the data voltages in response to the gate signals. The pixels PX display gray scales corresponding to the data voltages to display images corresponding to the image signals R, G and B.

Figure 3A:
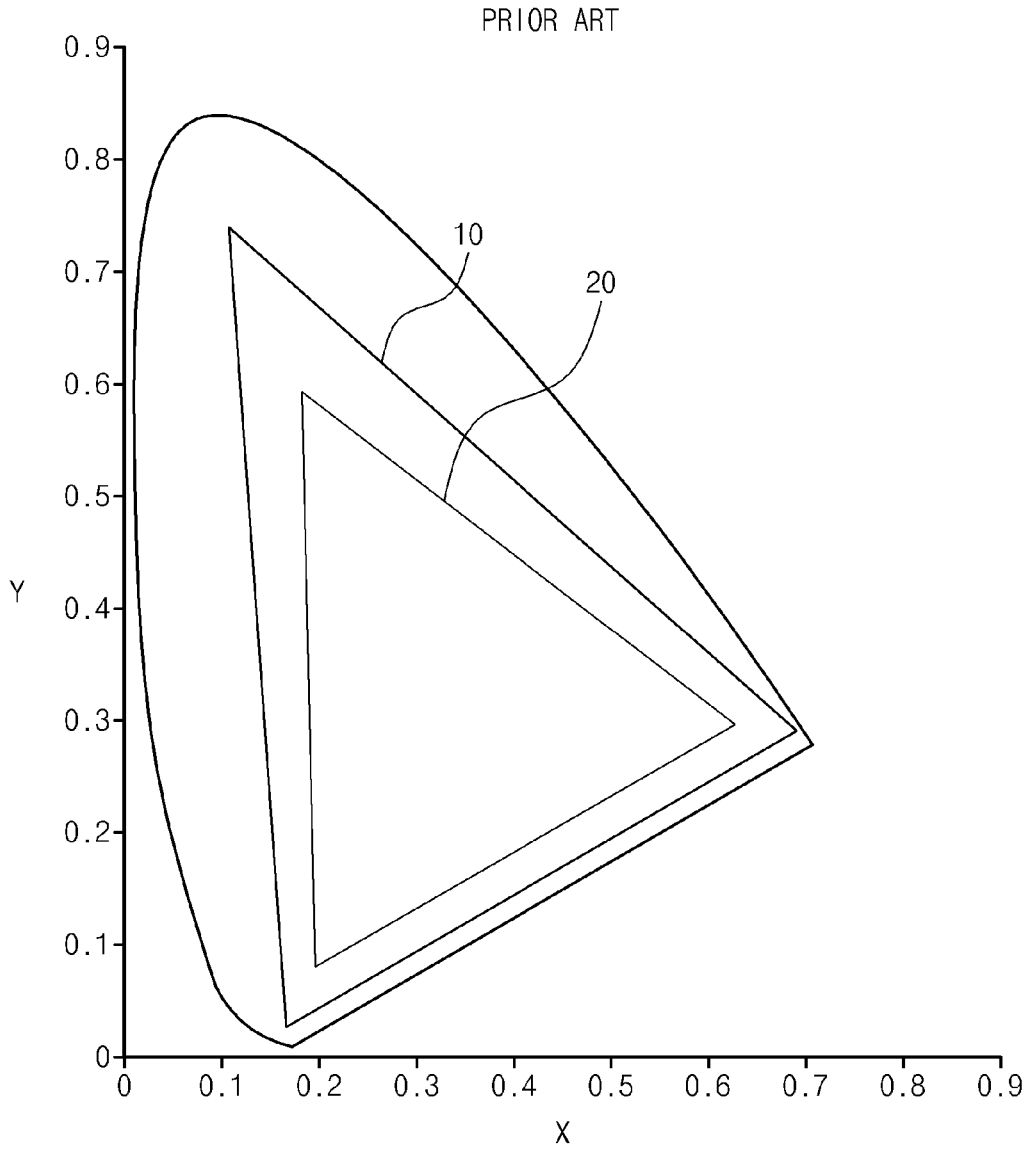
FIGS. 3A and 3B are views showing a conventional gamut mapping method.
Figure 3B:
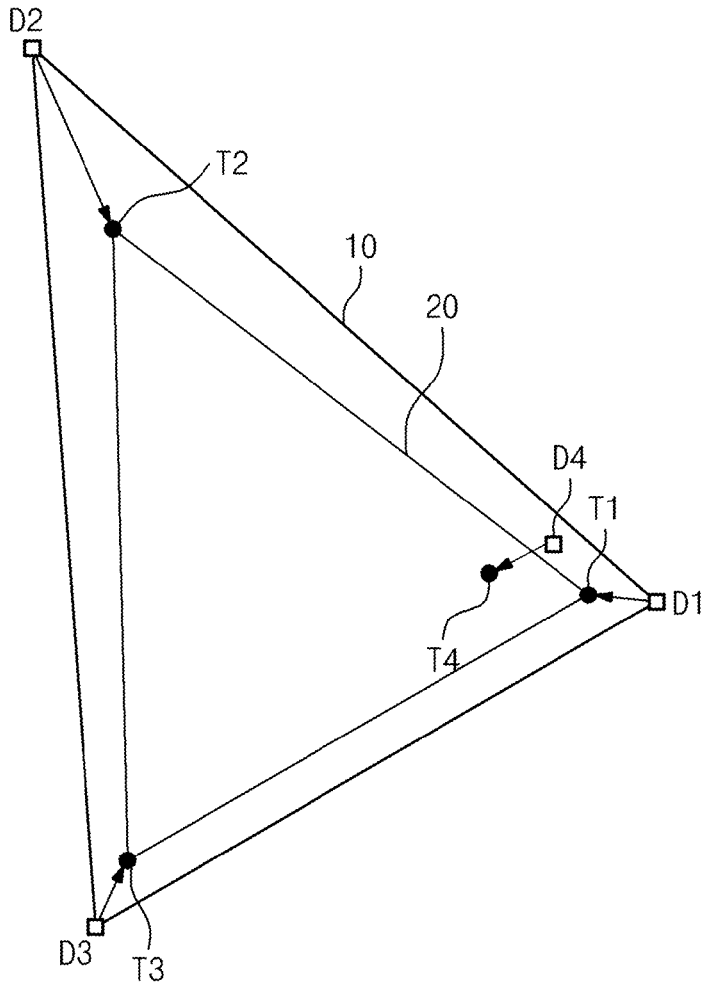
Fig. 3B PRIOR ART

FIGS. 3A and 3B are views showing a conventional gamut mapping method. FIG. 3A shows a color reproduction area 10 and a target color reproduction area 20 of a conventional display device in a CIE chromaticity diagram. For the convenience of illustration, FIG. 3B shows only the color reproduction area 10 and the target color reproduction area 20 without x- and y-axes of a color coordinate.

Referring to FIGS. 3A and 3B, the color reproduction area 10 of the display device is larger or wider than the target color reproduction area 20 of the display device as shown in the CIE chromaticity diagram of FIG. 3A. The color reproduction area 10 of the display device shown in FIG. 3A may be a color reproduction area 10 of an exemplary embodiment of the display device 100 according to the invention.

The target color reproduction area 20 corresponds to a predetermined color reproduction area, e.g., a color reproduction area desired by a user. That is, a color reproduction area corresponding to the image signals R, G and B may be the target color reproduction area 20.

In general, display devices have different color reproduction areas from each other. In addition, the target color reproduction area 20 desired by the user is different from the color reproduction area 10 of the display device 100. As shown in FIG. 3A, the color reproduction area 10 of the display device may be wider than the target color reproduction area 20.

When the gamut mapping is not performed, the image signals R, G and B are displayed as images of the color reproduction area 10 of the display device 100 and not displayed as images of the target color reproduction area 20 of the display device 100. Thus, in a display device, the gamut mapping that maps the image signals R, G and B from the images of the color reproduction area 10 to the images of the target color reproduction area 20 may be performed, that is, the display device 100 performs the gamut mapping to map the image signals R, G and B to the images of the target color reproduction area 20.

In a display device, as shown in FIG. 3B, the image signals R, G and B have a color coordinate of a first display position D1 in the color reproduction area 10 of the display device. When the gamut mapping is not performed, the image signals R, G and B have data values corresponding to the color coordinate of the first display position D1. Accordingly, the images based on the image signals R, G and B having the data values corresponding to the color coordinate of the first display position D1 may be abnormally displayed.

When the gamut mapping is performed, the color coordinate of the first display position D1 of the color reproduction area 10 of the display device 100 may be mapped to a color coordinate of a first target position T1 of the target color reproduction area 20. Accordingly, the image signals R, G and B have data values corresponding to the color coordinate of the first target position T1. As a result, the images based on the image signals R, G and B having the data values corresponding to the color coordinate of the first display position D1 may be displayed as the normal images corresponding to the first target position T1.

Similarly, a color coordinate of a second display position D2 of the color reproduction area 10 of the display device 100 may be mapped to a color coordinate of a second target position T2 of the target color reproduction area 20 of the display device 100 by the gamut mapping, a color coordinate of a third display position D3 of the color reproduction area 10 of the display device 100 may be mapped to a color coordinate of a third target position T3 of the target color reproduction area 20 of the display device 100 by the gamut mapping, and a color coordinate of a fourth display position D4 of the color reproduction area 10 of the display device 100 may be mapped to a color coordinate of a fourth target position T4 of the target color reproduction area 20 of the display device 100 by the gamut mapping.

The image signals R, G and B are mapped to the target color reproduction area 20 from the color reproduction area 10 of the display device 100 by the gamut mapping operation. As a result, image signals R, G and B having the data values corresponding to the color coordinate of the second, third and fourth display positions D2, D3 and D4 may be displayed as normal images.

In general, the gamut mapping is performed on the red, green and blue image signals R, G and B and not performed on the white image signal W. Accordingly, the color coordinate of the white image signal W is set to the color coordinate of the color reproduction area 10 of the display device.

Figure 4:
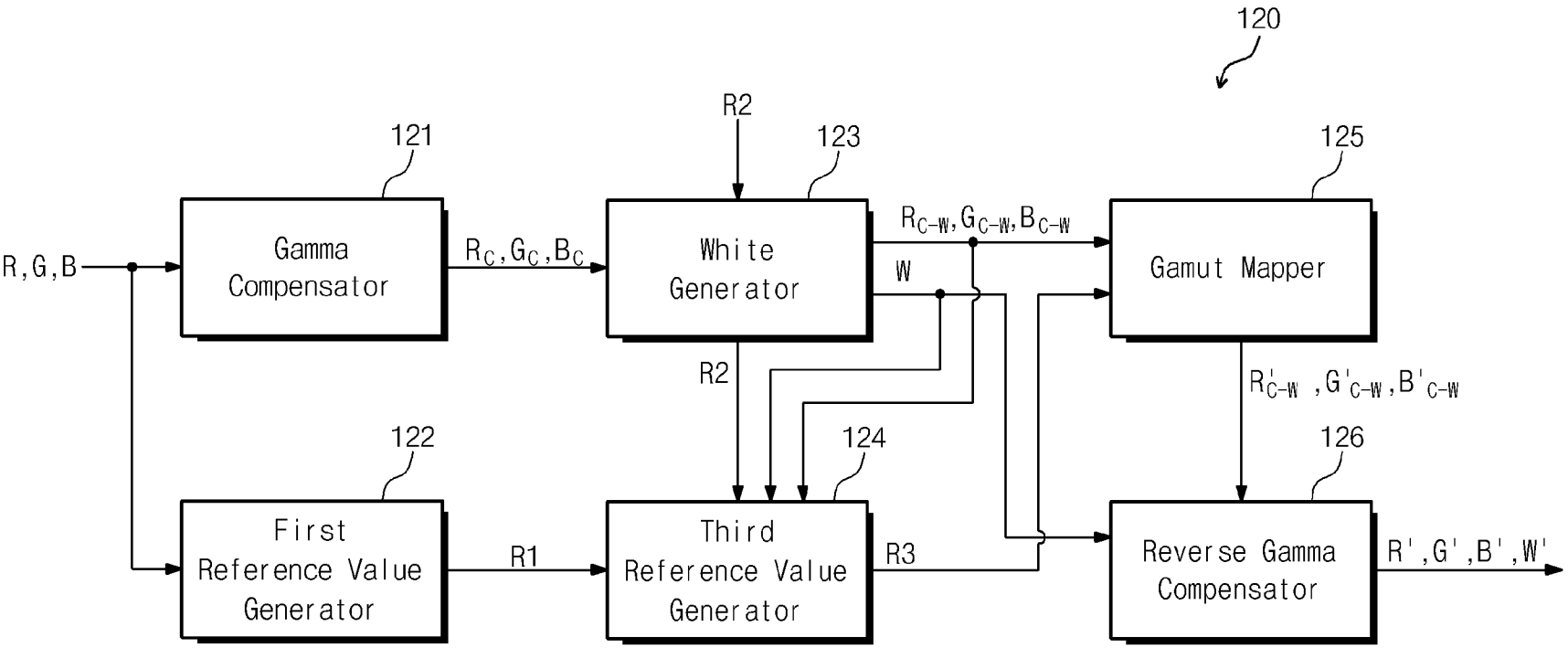
FIG. 4 is a block diagram showing an exemplary embodiment of a data processing device shown in FIG. 1.

FIG. 4 is a block diagram showing an exemplary embodiment of the data processing device shown in FIG. 1.

Referring to FIG. 4, the data processing device 120 includes a gamma compensator 121, a first reference value generator 122, a white generator 123, a third reference value generator 124, a gamut mapper 125 and a reverse gamma compensator 126.

The gamma compensator 121 of the data processing device 120 receives the image signals R, G and B. The image signals R, G and B include a red image signal R, a green image signal G and a blue image signal B.

The gamma compensator 121 performs a gamma compensation on the image signals R, G and B. In an exemplary embodiment, the input image signal having the nonlinear gray-scale display characteristic may be converted to the image signal having the linear gray-scale input-output characteristic by the gamma compensation.

The gamma compensator 121 provides gamma compensated image signals Rc, Gc and Bc, which are obtained by performing the gamma compensation on the image signals R, G and B, to the white generator 123. The gamma compensated image signals Rc, Gc and Bc are referred to as first image signals Rc, Gc and Bc.

In an exemplary embodiment, the first reference value generator 122 receives the image signals R, G and B. The first reference value generator 122 generates a first reference value R1 corresponding to a ratio of chromatic color using the image signals R, G and B. In one exemplary embodiment, for example, the first reference value generator 122 divides a minimum value among data values of the image signals R, G and B by a maximum value among the data values of the image signals R, G and B to calculate the first reference value R1. The first reference value generator 122 provides the first reference value R1 to the third reference value generator 124.

In such an embodiment, the image signals R, G and B may be image signals corresponding to an image of achromatic color. The image signals R, G and B corresponding to an image of the achromatic color may have the same data values, e.g., each of the data value of the red image signal R, the data value of the green image signal G and the data value of the blue image signal B may be "200", and the minimum and maximum values are the same as the value of "200".

In such an embodiment, when the image signals R, G and B are image signals corresponding to an image of achromatic color, the value obtained by dividing the minimum value by the maximum value is "1", and the first reference value R1 becomes "1". That is, when the chromatic color does not exist in the image signals R, G and B, the image signals R, G and B display the achromatic color, and the first reference value R1 becomes "1".

The image signals R, G and B may be image signals corresponding to an image of chromatic color. When the image signals R, G and B are image signals corresponding to an image of chromatic color, the image signals R, G and B have different data values from each other, e.g., the data value of the red image signal R, the data value of the green image signal G and the data value of the blue image signal B may be 200, 100 and 50, respectively, in which the minimum value of the data values of the image signals R, G and B is "50" and the maximum value of the data values of the image signals R, G and B is "200". The value obtained by dividing the minimum value by the maximum value is "¼". Therefore, the first reference value R1 becomes ¼.

In an exemplary embodiment, as the image signals R, G and B become closer to the red color, the data value of the red image signal R becomes greater relative to the data values of the green and blue image signals G and B. In this case, a difference between the maximum value and the minimum value becomes large, and thus the first reference value R1 approximates to zero (0).

As the image signals R, G and B become closer to the achromatic color, the first reference value R1 approximates to "1". As the image signals R, G and B become closer to the chromatic color, the first reference value R1 approximates to "0". Thus, the first reference value R1 has the value corresponding to the ratio of the chromatic color in the image signals R, G and B based on the color coordinate of the chromatic color.

The white generator 123 receives a second reference value R2 from an external source (not shown) and the first image signals Rc, Gc and Bc from the gamma compensator 121. The white generator 123 generates white data using the second reference value R2 and the first image signals Rc, Gc and Bc. The second reference value R2 is set to have a value between 0 and 1. The second reference value R2 may be pre-set by the user and provided to the white generator 123.

The second reference value R2 is determined by a ratio of the data value of the white image signal W used in the first image signals Rc, Gc and Bc. The white image signal W is provided to the white pixel Wx.

In an exemplary embodiment, the white generator 123 multiplies a minimum value among data values of the first image signals Rc, Gc and Bc by the second reference value R2. The value acquired by the multiplication is set as the data value of the white image signal W. In such an embodiment, the white generator 123 subtracts the data value of the white image signal W from the first image signals Rc, Gc and Bc. That is, the data value of the first image signals Rc, Gc and Bc is subtracted by the data value of the white image signal W.

When each of the data value of the red image signal Rc, the data value of the green image signal Gc and the data value of the blue image signal Bc of the first image signals Rc, Gc, and Bc used to display the achromatic color is "200", for example, the data values of the first image signals Rc, Gc and Bc are the same, and the minimum value becomes "200". The second reference value R2 may be set to "0.5".

In such an embodiment, the data value of the white image signal W is set by multiplying the minimum value, i.e., 200, by the second reference value R2, i.e., 0.5. Therefore, the data value of the white image signal W has a value of "100" obtained by multiplying the minimum value, i.e., 200, by the second reference value R2, i.e., 0.5.

The data values of the first image signals Rc, Gc and Bc are subtracted by the data value of the white image signal W. Accordingly, each of the data value of the red image signal Re, the data value of the green image signal Gc and the data value of the blue image signal Bc of the first image signals Rc, Gc and Bc is changed to "100".

When the data value of the red image signal Rc, the data value of the green image signal Gc and the data value of the blue image signal Bc of the first image signals Rc, Gc and Bc used to display the chromatic color may be "200", "100" and "50", respectively, the minimum value becomes "50". The second reference value R2 may be set to "0.5".

The data value of the white image signal W is set by multiplying the minimum value, i.e., 50, by the second reference value R2, i.e., 0.5. Therefore, the data value of the white image signal W has a value of "25" obtained by multiplying the minimum value, i.e., 50, by the second reference value R2, i.e., 0.5.

The data values of the first image signals Rc, Gc and Bc are subtracted by the data value of the white image signal W. Accordingly, the data value of the red image signal Rc, the data value of the green image signal Gc and the data value of the blue image signal Bc of the first image signals Rc, Gc and Bc are respectively changed to "175", "75" and "25".

In an exemplary embodiment, an amount of the data value of the white image signal W may be variously determined based on light emitting efficiency of the display device 100. In an exemplary embodiment, each of the pixels PX may emit a white light. In such an embodiment, red, green and blue color filters are disposed on (or under) the red, green and blue pixels Rx, Gx and Bx to respectively correspond to the red, green and blue pixels Rx, Gx and Bx. The white light emitted from the red, green and blue pixels Rx, Gx and Bx transmits through the red, green and blue color filters, and thus red, green and blue colors are provided to the user. In such an embodiment, the light emitting efficiency of the display device 100 may be lowered since optical loss of the light occurs due to the color filters.

In such an embodiment, the color filter is not disposed on or under the white pixel Wx. Accordingly, the optical loss of the light in the white pixel Wx is less than the optical loss of the red, green and blue pixels Rx, Gx and Bx. Therefore, as the data value of the white image signal W provided to the white pixel Wx is increased, the light emitting efficiency of the display device 100 may be increased.

However, when the amount of the data value of the white image signal W in use, that is, the data value of the white image signal W provided to the white pixel Wx, becomes substantially large, the data values of the red, green and blue image signals Rc, Gc and Bc become relatively small, such that the red, green and blue pixels Rx, Gx and Bx become dark as compared with the white pixel Wx. Thus, in an exemplary embodiment, the second reference value R2 is set to a value determined or controlled by the user.

In an exemplary embodiment, the white generator 123 provides the second reference value R2 to the third reference value generator 124. In such an embodiment, the white generator 123 provides the image signals Rc-w, Gc-w and Bc-w, from which the data value of the white image signal W is subtracted, to the gamut mapper 125 and the third reference value generator 124.

The image signals Rc-w, Gc-w and Bc-w, from which the data value of the white image signal W is subtracted, are referred to as second image signals Rc-w, Gc-w and Bc-w. The white generator 123 provides the white image signal W to the reverse gamma compensator 126 and the third reference value generator 124.

The third reference value generator 124 generates a first color coordinate using the second image signals Rc-w, Gc-w and Bc-w. The third reference value generator 124 generates a second color coordinate using the white image signal W. The third reference value generator 124 calculates a third reference value R3 using the first color coordinate, the second color coordinate, the first reference value R1 and the second reference value R2.

The third reference value R3 is calculated by the following Equation 1.

$$X''=X+((X-X')\times R1\times R2),\ Y''=Y+((Y-Y')\times R1\times R2) \qquad \text{Equation 1}$$

In Equation 1, X, X', X" indicate a horizontal axis coordinate of the color coordinate, and Y, Y', and Y" indicate a vertical axis coordinate of the color coordinate. A coordinate (X, Y) is referred to as a first color coordinate (X, Y) to indicate a color coordinate of a target position, a coordinate (X', Y') is referred to as a second color coordinate (X', Y') to indicate a color coordinate (X', Y') of the white image signal W, and a coordinate (X", Y") is referred to as a third color coordinate (X", Y") to indicate a color coordinate of a target position corresponding to the third reference value R3.

The first color coordinate (X, Y) corresponds to the color coordinate selected or desired by the user. The second color coordinate (X', Y') corresponds to the color coordinate of the white image signal W in the color reproduction area 10 of the display device 100. The third color coordinate (X", Y") corresponds to the color coordinate used for the gamut mapping of the second image signals Rc-w, Gc-w and Bc-w. The third color coordinate (X", Y") is provided to the gamut mapper 125 as the third reference value R3.

The gamut mapper 125 performs the gamut mapping on the second image signals Rc-w, Gc-w and Bc-w provided from the white generator 123 using the third reference value R3 provided from the third reference value generator 124. In one exemplary embodiment, for example, the gamut mapper 125 maps the second image signals Rc-w, Gc-w and Bc-w to the third color coordinate (X", Y") that is the third reference value R3.

The second image signals Rc-w, Gc-w and Bc-w are converted to image signals R'c-w, G'c-w and B'c-w having data values corresponding to the third color coordinate (X", Y") by the gamut mapping. The image signals R'c-w, G'c-w and B'c-w, on which the gamut mapping is performed, are referred to as third image signals R'c-w, G'c-w and B'c-w. The third image signals R'c-w, G'c-w and B'c-w are provided to the reverse gamma compensator 126.

The setting of the third reference value R3 and the gamut mapping operation based on the third reference value R3 will be described in detail with reference to the color reproduction area 10 and the target color reproduction area 20 of the display device 100 shown in FIGS. 5A to 5E, 6A and 6B, and 7A and 7B.

The reverse gamma compensator 126 converts the third image signals R'c-w, G'c-w, and B'c-w from the gamut mapper 125 and the white image signal W from the white generator 123 to the image signals in which the gamma compensation is not performed. That is, the reverse gamma compensator 126 performs a reverse gamma compensation on the third image signals R'c-w, G'c-w and B'c-w and the white image signal W. The processed image signals R', G', B' and W', on which the reverse gamma compensation is performed, are provided to the timing controller 130.

Figure 5A:
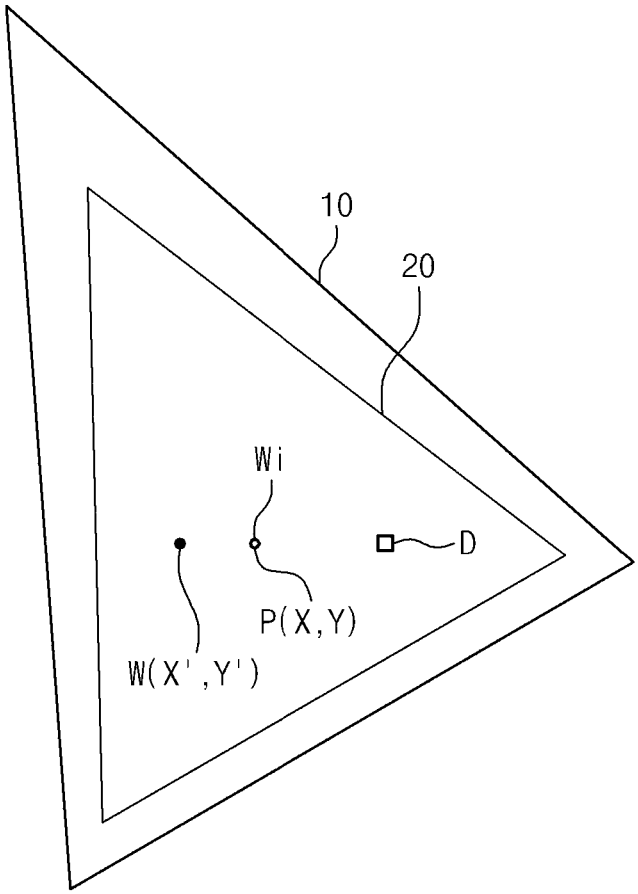
FIGS. 5A and 5E showing a gamut mapping in an exemplary embodiment of the data processing device to display an achromatic color.
Figure 5B:
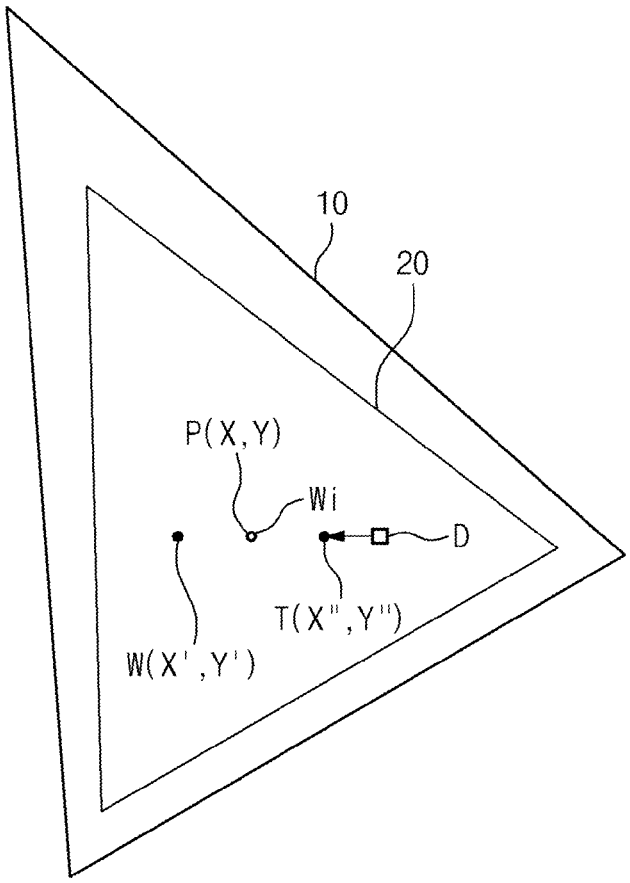
Figure 5C:
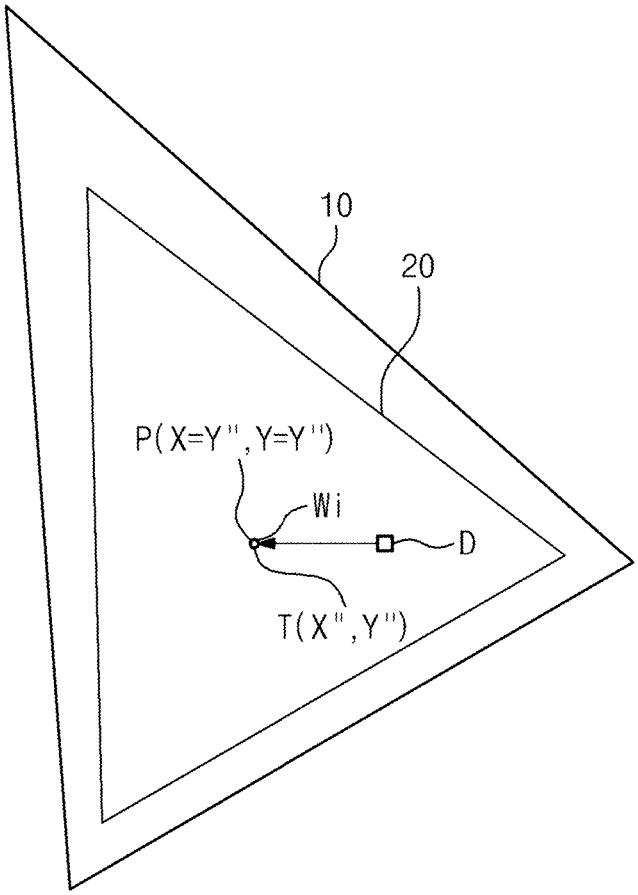
Figure 5D:
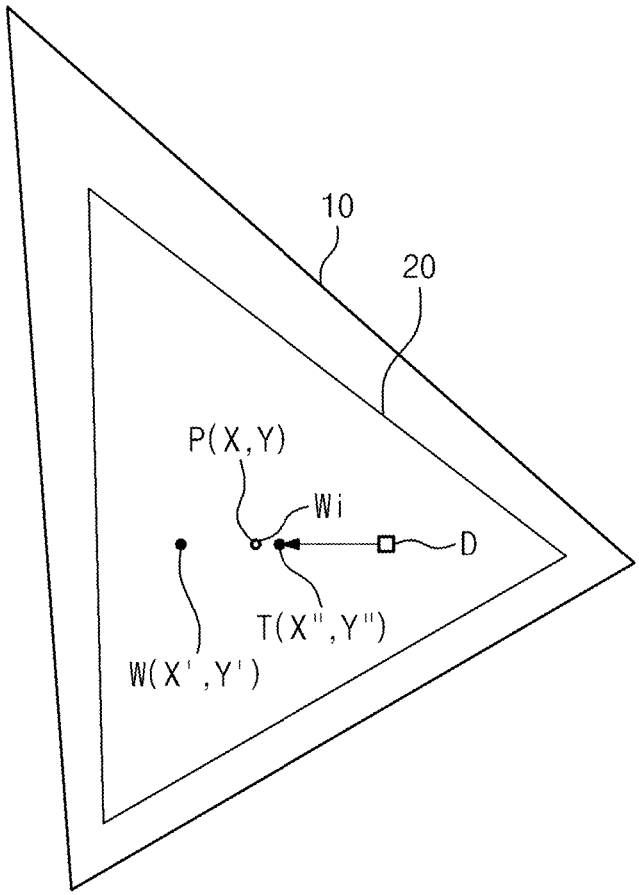
Figure 5E:
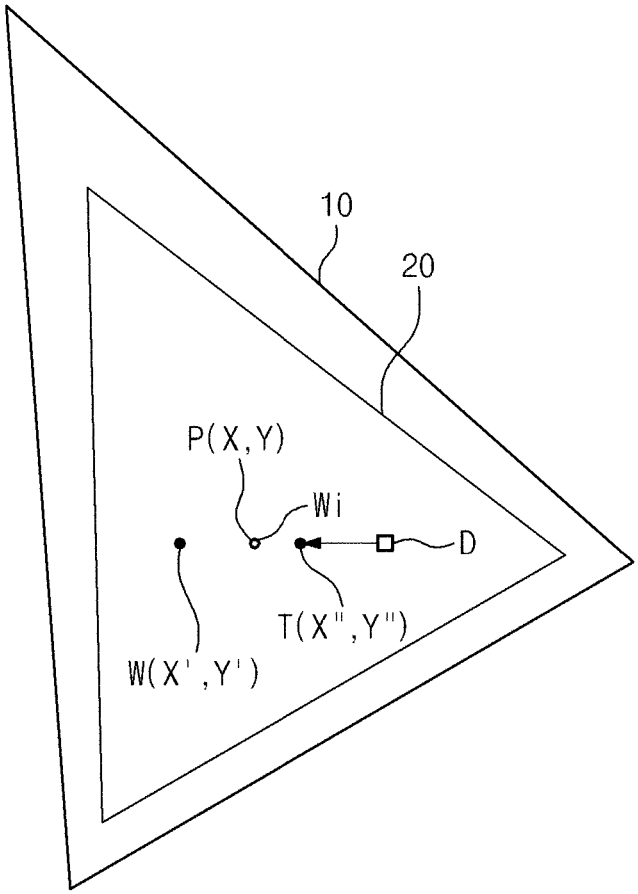

FIGS. 5A and 5E showing the gamut mapping in an exemplary embodiment of the data processing device to display the achromatic color.

Referring to FIG. 5A, the color coordinate (X', Y') of the white image signal W, which is the second color coordinate (X', Y'), is the color coordinate in the color reproduction area 10 of the display device 100. As shown in FIG. 5A, the second color coordinate (X', Y') may not have a color coordinate value of a white position Wi. The white position Wi may be defined as a color coordinate of an image in which the white color is displayed. Accordingly, when the white image signal W is provided to the white pixel Wx, the white pixel Wx may not display a perfect white color.

As described above, the gamut mapping is not performed on the white image signal W. Therefore, the white image signal W has the second color coordinate (X', Y') and the second color coordinate (X', Y') is not changed.

The color coordinate (X, Y) of the target position P, which is the first color coordinate (X, Y), is set by the second image signals Rc-w, Gc-w and Bc-w output from the white generator 123. In an exemplary embodiment, as described above, the achromatic color image signals have a same data value as each other. Thus, when the data processing device 120 receives the achromatic color, the second image signals Rc-w, Gc-w and Bc-w output from the white generator 123 have the same value.

The achromatic color image signals are used to display the white color. That is, the color desired by the user is the white color. Accordingly, the color coordinate (X, Y) of the target position P is set to the color coordinate of the white position Wi with reference to the second image signals Rc-w, GC-w and Bc-w.

As described above, the color reproduction area 10 of the display device 100 may be different from the target color reproduction area 20 of the display device 100. Therefore, although the second image signals Rc-w, Gc-w and Bc-w are the image signals used to display the white color, the white color may not be displayed in the color reproduction area 10 of the display device 100. In such an embodiment, as shown in FIG. 5A, the second image signals Rc-w, Gc-w and Bc-w may have the color coordinate of the display position D in the color reproduction area 10 of the display device 100, for example.

Referring to FIG. 5B, since the gamut mapping is not performed on the white image signal W, the gamut mapping is performed on the color coordinate of the display position D.

The image desired by the user is the white color, but the color coordinate (X', Y') of the white image signal W does not display the white color. The white color may be displayed by the combination of the white image signal W and the second image signals Rc-w, Gc-w and Bc-w. That is, the white color is displayed by the combination of the light emitted from the white pixel Wx and lights emitted from the red, green and blue pixels Rx, Gx and Bx.

When the image desired by the user is the white color, the color coordinate (X, Y) of the target position D is set to the white position Wi. However, the first color coordinate (X, Y) indicates the white color and the second color coordinate (X', Y') does not indicate the white color. When the first color coordinate (X, Y) is combined with the second color coordinate (X', Y'), the white color is substantially not displayed.

Due to the gamut mapping operation, the color coordinate of the display position D may be changed to a position corresponding to a difference between the first color coordinate (X, Y) and the second color coordinate (X', Y'). That is, the color coordinate of the display position D may be changed such that the white color is substantially displayed by the combination of the color displayed by the second image signals Rc-w, Gc-w and Bc-w and the color displayed by the white image signal W.

In an exemplary embodiment, when the image signals R, G and B are the achromatic color image signals, the first reference value R1 is set to "1" in Equation 1. As the amount of the data value of the white image signal W in use becomes large, the second reference value R2 approximates to "1".

When the second reference value R1 is "1", each data value of the second image signals Rc-w, Gc-w and Bc-w becomes "0". According to Equation 1, the color coordinate (X", Y") of the target position T is determined by adding a value of the first color coordinate (X, Y) to a value obtained by subtracting a value of the second color coordinate (X', Y') from a value of the first color coordinate (X, Y). Thus, the color coordinate (X", Y") of the target position T has the color coordinate corresponding to the second color coordinate (X', Y') with reference to the color coordinate (X, Y) of the target position P as shown in FIG. 5B.

The color coordinate (X", Y") of the target position T, which is calculated by the third reference value generator 124, is provided to the gamut mapper 125 as the third reference value R3. The second image signals Rc-w, Gc-w and Bc-w are mapped to have the color coordinate (X", Y") of the target position T by the gamut mapping of the gamut mapper 125.

Accordingly, the second image signals Rc-w, Gc-w and Bc-w are converted to the third image signals R'c-w, G'c-w and B'c-w having the data values corresponding to the color coordinate (X", Y") of the target position T. In this case, the white color may be displayed by the combination of the light generated by the white image signal W and the lights generated by the third image signals Rc-w, Gc-w and Bc-w.

In an exemplary embodiment, the color coordinate (X", Y") of the target position T may be modified based on the amount of the data value of the white image signal W in use. The modification of the color coordinate (X", Y") of the target position T based on the amount of the data value of the white image signal W in use will be described in detail with reference to FIGS. 5C to 5E.

Referring to FIG. 5C, in an exemplary embodiment, when the input image signals display the achromatic color and the second reference value R2 is "0", the white generator 123 does not generate the white image signal W. That is, the white pixel Wx is not used. Since the white image signal W is not generated, the second color coordinate (X', Y') corresponding to the color coordinate of the white image signal W is not shown in FIG. 5C.

In such an embodiment, where the white image signal W is not generated when the input image signals display the achromatic color, the second image signals Rc-w, Gc-w and Bc-w have the same data values as the first image signals Rc, Gc and Bc. In such an embodiment, the white color may be displayed by the third image signals R'c-w, G'c-w and B'c-w obtained by gamut-mapping the second image signals Rc-w, Gc-w and Bc-w.

In such an embodiment, when the second reference value R2 is "0", the color coordinate (X", Y") of the target position T is set to the color coordinate (X, Y) of the target position P in Equation 1. The color coordinate (X, Y) of the target position P is the color coordinate of the white position Wi. The color coordinate (X, Y) of the target position P, which is set to the color coordinate (X", Y") of the target position T, is provided to the gamut mapper 125 as the third reference value R3.

Due to the gamut mapping of the gamut mapper 125, the second image signals Rc-w, Gc-w and Bc-w are converted to the third image signals R'c-w, G'c-w and B'c-w having the data values corresponding to the color coordinate (X, Y) of the target position P, such that the white color may be displayed by the light generated by the third image signals R'c-w, G'c-w and B'c-w.

Referring to FIGS. 5D and 5E, in an exemplary embodiment, the input image signals R, G and B may display the achromatic color, and the second reference value R2 may be greater than zero (0) and less than 1. In such an embodiment, the second reference value R2 is multiplied with a value obtained by subtracting the second color coordinate (X', Y') from the first color coordinate (X, Y) as represented by Equation 1. The color coordinate (X", Y") of the target position T is determined by adding the first color coordinate (X, Y) to the value multiplied with the second reference value R2.

Therefore, as shown in FIGS. 5D and 5E, the color coordinate (X", Y") of the target position T is set to a position closer to the color coordinate (X, Y) of the target position P than the position of the color coordinate (X", Y") of the target position T shown in FIG. 5B.

The color coordinate (X", Y") of the target position T, which is calculated by the third reference value generator 124, is provided to the gamut mapper 125 as the third reference value R3. The second image signals Rc-w, Gc-w and Bc-w are mapped to have the color coordinate (X", Y") of the target position T by the gamut mapping operation of the gamut mapper 125.

Thus, the second image signals Rc-w, Gc-w and Bc-w are converted to the third image signals R'c-w, G'c-w and B'c-w having the data values corresponding to the color coordinate (X", Y") of the target position T, such that the white color may be displayed by the combination of the light generated by the white image signal W and the lights generated by the third image signals R'c-w, G'c-w and B'c-w.

As the amount of the data value of the white image signal W in use becomes small, the second reference value R2 approximates to "0". The color coordinate (X", Y") of the target position T is set to be closer to the color coordinate (X, Y) of the target position P as shown in FIG. 5D as the amount of the data value of the white image signal W in use becomes small. When the data value of the white image signal W is not used, the color coordinate (X", Y") of the target position T is set to the color coordinate (X, Y) of the target position P.

As the amount of the data value of the white image signal W in use becomes large, the second reference value R2 approximates to "1". As shown in FIG. 5D, the color coordinate (X", Y") of the target position T becomes farther away from the color coordinate (X, Y) of the target position P than the color coordinate (X", Y") of the target position T shown in FIG. 5D as the amount of the data value of the white image signal W in use becomes large. However, the color coordinate (X", Y") of the target position T shown in FIG. 5E is positioned between the color coordinate (X, Y) of the target position P and the color coordinate (X", Y") of the target position T shown in FIG. 5B.

When the image signals Rc, Gc and Bc are used as white data, the color coordinate (X", Y") of the target position T is determined as the color coordinate corresponding to the second color coordinate (X', Y') with reference to the color coordinate (X, Y) of the target position P shown in FIG. 5B.

Accordingly, the color coordinate (X", Y") of the target position T may be set by the amount of the data value of the white image signal W in use, which corresponds to the second reference value R2 in Equation 1.

If the color coordinate (X", Y") of the target position T is set without consideration of the amount of the data value of the white image signal W in use, the white color may not be normally displayed. For instance, when the second reference value R2 is not used and the image signals R, G and B may be image signals used to display the achromatic color, Equation 1 is modified to an Equation, from which the second reference value R2 is omitted. As described above, when the image signals R, G and B are the image signals used to display the achromatic color, the first reference value R1 is always set to "1". Accordingly, Equation 1 may be modified to the following Equation 2.

$$X''=X+(X-X'),Y''=Y+(Y-Y') \quad \text{Equation 2}$$

As shown in Equation 2, the color coordinate (X", Y") of the target position T is determined by adding a value of the first color coordinate (X, Y) to a value obtained by subtracting a value of the second color coordinate (X', Y') from a value of the first color coordinate (X, Y). The color coordinate (X", Y") of the target position T does not indicate the color coordinate of the white position Wi. The image signals R, G and B are required to be mapped to the color coordinate (X, Y) of the target position P, which is the color coordinate of the white position Wi, to display the achromatic color. However, when the second reference value R2 is not used, the color coordinate (X", Y") of the target position T does not indicate the color coordinate of the white position Wi. As a result, the white color may not be normally displayed.

In an exemplary embodiment, the data processing device 120 sets the color coordinate (X", Y") of the target position T based on the amount of the data value of the white image signal W in use, which corresponds to the second reference value R2. Therefore, when the image signals R, G and B display the achromatic color, the gamut mapping operation may be normally performed.

Figure 6A:
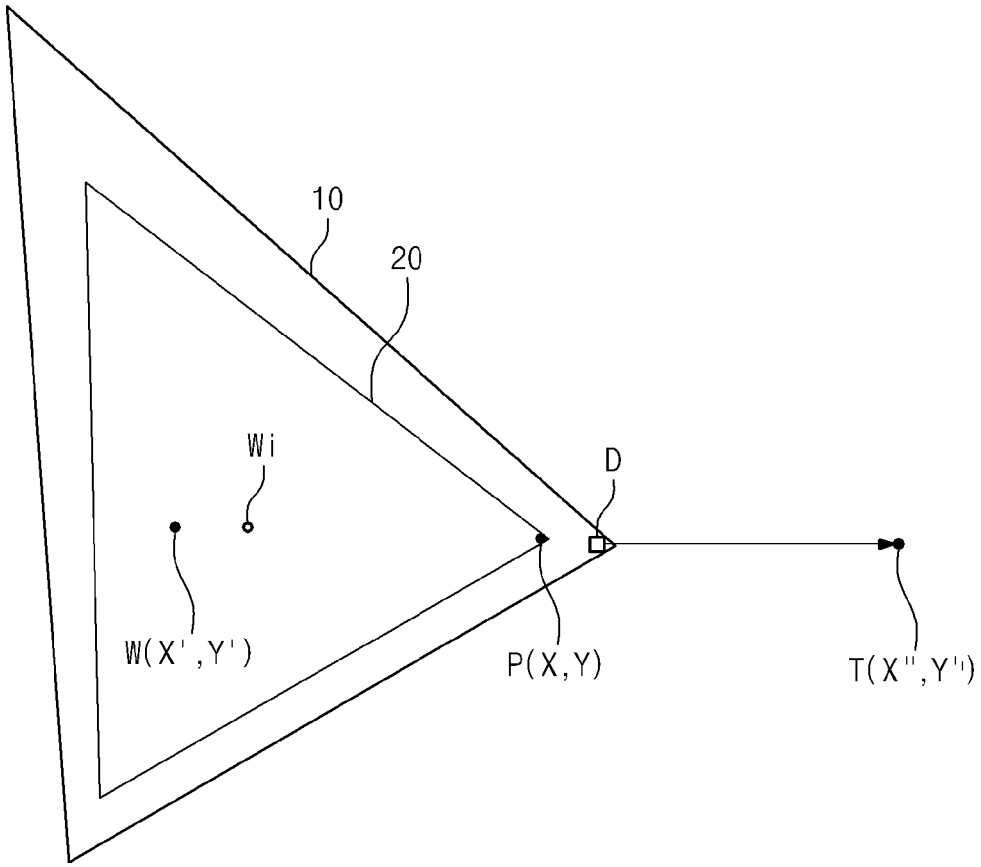
FIGS. 6A and 6B are views showing a color coordinate of a target position of a chromatic color when first and second reference values are not used in Equation 1.
Figure 6B:
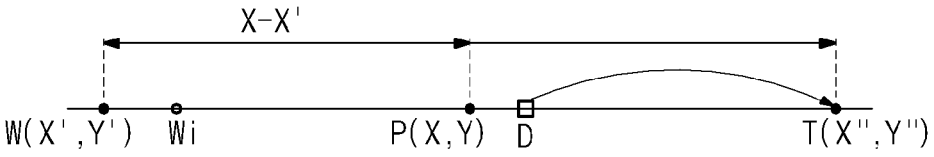
Figure 7A:
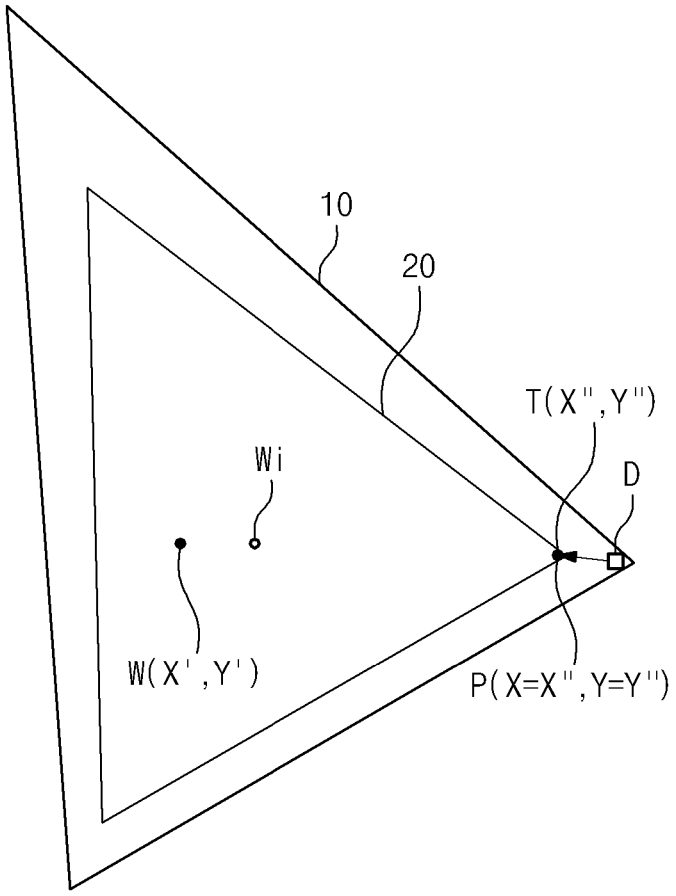
FIGS. 7A and 7B are views showing the color coordinates of the target position of the chromatic color, which are calculated by Equation 1.
Figure 7B:
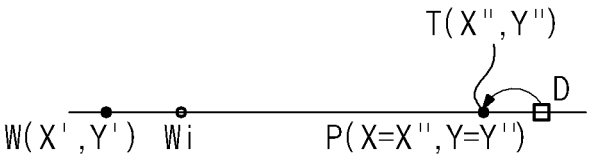

FIGS. 6A and 6B are views showing a color coordinate of the target position of the chromatic color when the first and second reference values are not used in Equation 1, and FIGS. 7A and 7B are views showing the color coordinate of the target position of the chromatic color, which are calculated by Equation 1.

In FIGS. 6B and 7B, for the convenience of illustration, the color coordinates shown in FIGS. 6A and 7A are shown in one dimension.

Referring to FIGS. 6A and 6B, the image signals R, G and B may be the image signals to display the chromatic color. When the image signals R, G and B display the red color R, the color coordinate of the display position D is set to correspond to the position in the target color reproduction area 20 of the display device 100 shown in FIG. 6A.

When the gamut mapping is normally performed, the color coordinate of the display position D of the color reproduction area 10 of the display device 100 is mapped to the color coordinate (X, Y) of the target position P of the target color reproduction area 20. Accordingly, the third reference value generator 124 may set the color coordinate (X, Y) of the target position P to correspond to the position of the target color reproduction area 20 shown in FIG. 6A using the second image signals Rc-w, Gc-w and Bc-w.

When the gamut mapping is performed without consideration of the amount of the data value of the white image signal W in use and the ratio of the chromatic color, the first and second reference values R1 and R2 are not used. Accordingly, the color coordinate (X", Y") of the target position T is determined by Equation 2.

The color coordinate (X", Y") of the target position T is determined by adding the value of the first color coordinate (X, Y) to the value obtained by subtracting the value of the second color coordinate (X', Y') from the first color coordinate (X, Y) by Equation 2. The color coordinate (X", Y") of the target position T becomes farther away from the color coordinate (X, Y) of the target position P, and the color coordinate (X", Y") of the target position T may be set to a position deviated from the target color reproduction area 20 and the color reproduction area 10 of the display device 100.

When the gamut mapping is normally performed, the color coordinate (X", Y") of the target position T mapped such that the color coordinate (X", Y") of the target position T becomes approximate to the color coordinate (X, Y) of the target position P. However, the color coordinate (X", Y") of the target position T is set to be far away from the color coordinate (X, Y) of the target position P by Equation 2. Accordingly, the gamut mapping is not normally performed.

Referring to FIGS. 7A and 7B, the image signals R, G and B are the image signals to display the chromatic color. In an exemplary embodiment, when the image signals R, G and B are the image signals to display the chromatic color, the first reference value R1 is less than 1. In such an embodiment, when the data value of the white image signal W is used, the second reference value R2 is less than 1.

In one exemplary embodiment, for example, as the color displayed by the image signals R, G and B becomes the red color R as shown in FIG. 7A, the data value of the red image signal R becomes large, and the data values of the green and blue image signals G and B become relatively small. When the color displayed by the image signals R, G and B becomes the red color R, the first reference value R1 becomes approximate to zero (0).

According to Equation 1, the first and second reference values R1 and R2 are multiplied with the value obtained by subtracting the value of the second color coordinate (X', Y') from the value of the first color coordinate (X, Y). The color coordinate (X", Y") of the target position T is determined by adding the value of the first color coordinate (X, Y) to the value multiplied with the first and second reference values R1 and R2.

In an exemplary embodiment, as the first reference value R1 becomes small, the color coordinate (X", Y") of the target position T becomes approximate to the color coordinate (X, Y) of the target position P. In such an embodiment, as the second reference value R2 becomes small, the color coordinate (X", Y") of the target position T becomes approximate to the color coordinate (X, Y) of the target position P.

Therefore, the color coordinate (X", Y") of the target position T, which is calculated by Equation 1, is set to be closer to the color coordinate (X, Y) of the target position P than the color coordinate (X", Y") of the target position T, which is calculated by Equation 2. As a result, when the color coordinate (X", Y") of the target position T is set by Equation 1, the gamut mapping may be normally performed compared to a case when the color coordinate (X", Y") of the target position T is set by Equation 2.

In an exemplary embodiment, when the image signals R, G and B have the data value of the red image signal R and the data values of the green and blue image signals G and B are zero (0), the first reference value R1 is set to zero (0). Thus, the color coordinate (X", Y") of the target position T is set to be equal to the color coordinate (X, Y) of the target position P. Therefore, the gamut mapping may be normally performed.

As the image signals R, G and B approximate to the achromatic color, the first reference value R1 becomes approximate to 1. As the first reference value R1 approximates to 1, the color coordinate (X', Y') of the target position P becomes closer to the color coordinate of the white position Wi. The color coordinate (X", Y") of the target position T has the color coordinate spaced apart from the color coordinate (X', Y') of the target position P by a predetermined distance by the first and second reference values R1 and R2. However, the color coordinate (X", Y") of the target position T is set to be closer to the color coordinate (X', Y') of the target position P than the color coordinate (X", Y") of the target position T shown in FIGS. 6A and 6B.

When the image signals R, G and B display the achromatic color, the color coordinate (X', Y') of the target position P is set to the color coordinate of the white position Wi as described with reference to FIGS. 5A to 5E. Accordingly, the color coordinate (X", Y") of the target position T is determined by based only on the second reference value R2.

The color coordinate (X", Y") of the target position T, which is calculated by the third reference value generator 124, is provided to the gamut mapper 125 as the third reference value R3. The second image signals Rc-w, Gc-w and Bc-w are mapped to have the color coordinate (X", Y") of the target position T by the gamut mapping operation of the gamut mapper 125. As a result, the second image signals Rc-w, Gc-w and Bc-w are converted to the third image signals R'c-w, G'c-w, and B'c-w having the data values corresponding to the color coordinate (X", Y") of the target position T.

Accordingly, in an exemplary embodiment, the display device 100 may normally perform the gamut mapping operation based on the amount of the white image signal W in use and the ratio of the chromatic color, as described above.

Figure 8:
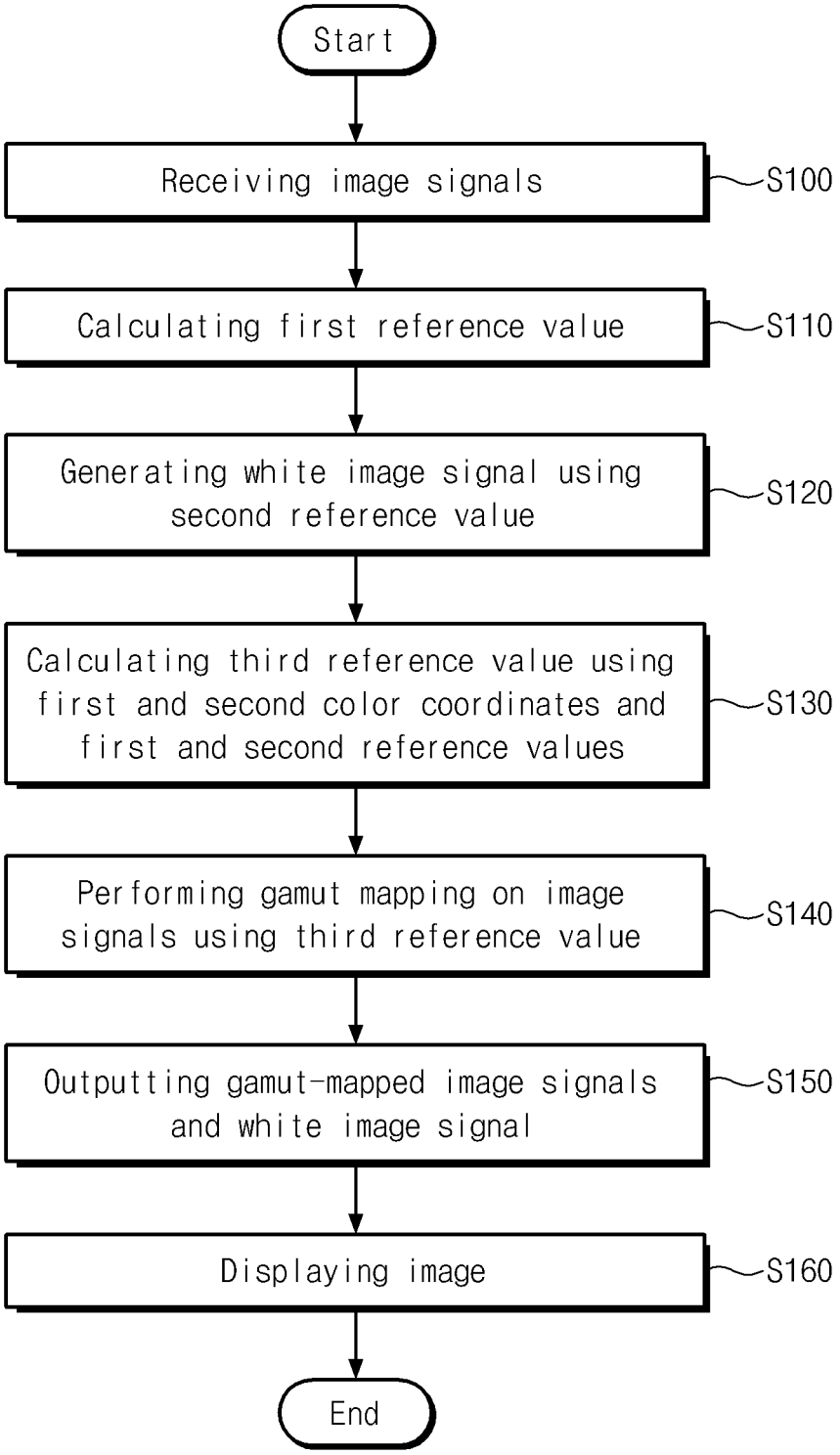
FIG. 8 is a flowchart showing an exemplary embodiment of a gamut mapping method of the display device, according to the invention.

FIG. 8 is a flowchart showing an exemplary embodiment of a gamut mapping method of the display device, according to the disclosure.

Referring to FIG. 8, when the image signals R, G and B are input (S100), the first reference value R1 is calculated using the image signals R, G and B (S110). In an exemplary embodiment, as described above, the first reference value R1 is obtained by dividing the minimum value among the data values of the image signals R, G and B by the maximum value among the data values of the image signals R, G and B.

Then, the white image signal W is generated using the second reference value R2 (S120). In an exemplary embodiment, as described above, the white image signal W is generated by multiplying the minimum value of the first image signals Rc, Gc and Bc by the second reference value. The second image signals Rc-w, Gc-w and Bc-w are generated by subtracting the data value of the white image signal W from the data values of the first image signals Rc, Gc and Bc.

The third reference value R3, which corresponds to the color coordinate (X", Y") of the target position P, is generated using the first color coordinate (X, Y), the second color coordinate (X', Y'), the first reference value R1 and the second reference value R2 (S130). In an exemplary embodiment, as described above, the first color coordinate (X, Y) and the second color coordinate (X', Y') are set by using the second image signals Rc-w, Gc-w and Bc-w, and the white image signal W. The third reference value R3 is calculated by applying the first color coordinate (X, Y), the second color coordinate (X, Y,), the first reference value R1 and the second reference value R2 to Equation 1.

The gamut mapping is performed on the second image signals Rc-w, Gc-w and Bc-w using the third reference value R3 (S140). In an exemplary embodiment, as described above, the second image signals Rc-w, Gc-w and Bc-w are converted to the third image signals R'c-w, G'c-w and B'c-w having the data value corresponding to the third reference value R3 by the gamut mapping.

The third image signals R'c-w, G'c-w and B'c-w, and the white image signal W are output (S150). In an exemplary embodiment, as described above, the reverse gamma compensation is performed on the third image signals R'c-w, G'c-w and B'c-w, and the white image signal W, and thus the processed image signals R', G', B' and W' are output. Then, the image corresponding to the processed image signals R', G', B' and W' is displayed (S160).

Accordingly, in an exemplary embodiment, the display device 100 may normally perform the gamut mapping operation based on the amount of the white image signal W in use and the ratio of the chromatic color.

Figure 9:
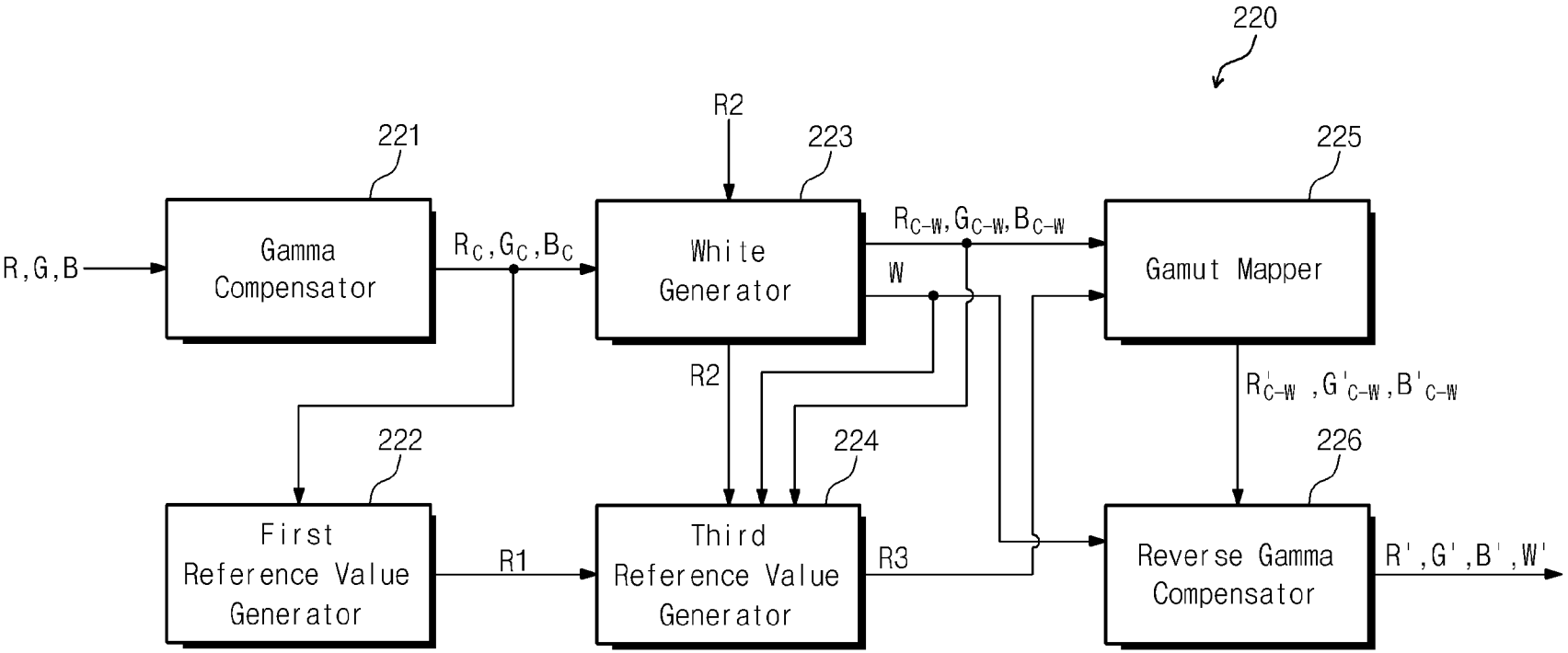
FIG. 9 is a block diagram showing an alternative exemplary embodiment of a data processing device of a display device, according to the invention.

FIG. 9 is a block diagram showing an alternative exemplary embodiment of a data processing device of a display device, according to the invention.

Referring to FIG. 9, an alternative exemplary embodiment of a data processing device 220 includes a gamma compensator 221, a first reference value generator 222, a white generator 223, a third reference value generator 224, a gamut mapper 225 and a reverse gamma compensator 226. The first reference value generator 222 receives first image signals Rc, Gc and Bc output from the gamma compensator 221. The first reference value generator 222 calculates a first reference value R1 using the first image signals Rc, Gc and Bc.

The configurations and the gamut mapping operation of the data processing device 220 shown in FIG. 9 are substantially the same as those of the data processing device 120 shown in FIG. 4. Accordingly, any repetitive detailed descriptions of the configurations and the gamut mapping operation of the data processing device 220 will be omitted.

In an exemplary embodiment, the data processing device 220 calculates the first reference value R1 using the first image signals Rc, Gc and Bc, as shown in FIG. 9. In such an embodiment, the first image signals Rc, Gc, and Bc that display the achromatic color have the same data value, and the first image signals Rc, Gc and Bc that display the chromatic color have the different data values.

In such an embodiment, as the ratio of the chromatic color becomes high, the difference between the maximum value and the minimum value in the data values of the first image signals Rc, Gc and Bc becomes large. In such an embodiment, where the first reference value R1 is calculated by using the first image signals Rc, Gc and Bc, the gamut mapping, which is similar to the gamut mapping performed by the data processing device 120 shown in FIG. 4, may be effectively performed.

In an exemplary embodiment, as described above, the display device may normally perform the gamut mapping operation based on the amount of the white image signal W in use and the ratio of the chromatic color.

Although some exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A data processing device comprising:

a first reference value generator which generates a first reference value corresponding to a ratio of a chromatic color using image signals or first image signals obtained by gamma-compensating the image signals;

a white generator which generates a white image signal and second image signals using the first image signals and generates a second reference value corresponding to an amount of a white data in use;

a third reference value generator which generates a third reference value using a first color coordinate, a second color coordinate, the first reference value and the second reference value, wherein the first color coordinate corresponds to a color coordinate of the second image signals, and the second color coordinate corresponds to a color coordinate of the white image signal; and a gamut mapper which maps the second image signals to a color coordinate corresponding to the third reference value to generate third image signals, wherein the third reference value is set by adding the first color coordinate to a value, which is obtained by multiplying the first and second reference values by a value, which is obtained by subtracting the second color coordinate from the first color coordinate.

2. The data processing device of claim 1, further comprising:

a gamma compensator which gamma-compensates the image signals and outputs the gamma-compensated image signals as the first image signals; and a reverse gamma compensator which performs a reverse gamma compensation on the third image signals and the white image signal, and outputs the reverse gamma compensated third and white image signals.

3. The data processing device of claim 1, wherein the first reference value is set by dividing a minimum value among data values of the image signals by a maximum value among the data values of the image signals or by dividing a minimum value among data values of the first image signals by a maximum value among the data values of the first image signals.

4. The data processing device of claim 1, wherein the second reference value is set to a value between 0 and 1, and the white image signal is set by multiplying a minimum value among data values of the first image signals by the second reference value.

5. The data processing device of claim 4, wherein data values of the second image signals are set by subtracting a data value of the white image signal from the data values of the first image signals.

6. A display device comprising:

a data processing device which generates a white image signal using image signals input thereto and performs a gamut mapping on the image signals;

a display panel comprising a plurality of pixels; and a driving circuit which drives the pixels using the white image signal and the gamut-mapped image signals, wherein the data processing device comprises:

a first reference value generator which generates a first reference value corresponding to a ratio of a chromatic color using the image signals or first image signals obtained by gamma-compensating the image signals;

a white generator which generates the white image signal and second image signals using the first image signals and a second reference value corresponding to an amount of a white data in use;

a third reference value generator which generates a third reference value using a first color coordinate, a second color coordinate, the first reference value and the second reference value, wherein the first color coordinate corresponds to a color coordinate of the second image signals, and the second color coordinate corresponds to a color coordinate of the white image signal; and a gamut mapper which maps the second image signals to a color coordinate corresponding to the third reference value to generate the gamut-mapped image signals, wherein the third reference value is set by adding the first color coordinate to a value, which is obtained by multiplying the first and second reference values by a value, which is obtained by subtracting the second color coordinate from the first color coordinate.

7. The display device of claim 6, wherein the pixels comprise:

color pixels which display an image corresponding to the gamut-mapped image signals; and a white pixel which displays an image corresponding to the white image signal.

8. The display device of claim 6, further comprising:

a gamma compensator which gamma-compensates the image signals, and outputs the gamma-compensated image signals as the first image signals; and a reverse gamma compensator which performs a reverse gamma compensation on the gamma-compensated image signals and the white image signal, and outputs the reverse gamma compensated gamut-mapped and white image signals to the driving circuit.

9. The data display device of claim 6, wherein the first reference value is set by dividing a minimum value among data values of the image signals by a maximum value among the data values of the image signals or by dividing a minimum value among data values of the first image signals by a maximum value among the data values of the first image signals.

10. The display device of claim 6, wherein the second reference value is set to a value between 0 and 1, and the white image signal is set by multiplying a minimum value among data values of the first image signals by the second reference value.

11. The display device of claim 10, wherein data values of the second image signals are set by subtracting a data value of the white image signal from the data values of the first image signals.

12. A gamut mapping method comprising:

calculating a first reference value corresponding to a ratio of a chromatic color using image signals or first image signals obtained by gamma-compensating for the image signals;

generating a white image signal and second image signals using the first image signals and a second reference value corresponding to an amount of a white data in use;

generating a third reference value using a first color coordinate, a second color coordinate, the first reference value and the second reference value, wherein the first color coordinate corresponds to a color coordinate of the second image signals, and the second color coordinate corresponds to a color coordinate of the white image signal; and mapping the second image signals to a color coordinate corresponding to the third reference value to generate third image signals, wherein the third reference value is set by adding the first color coordinate to a value, which is obtained by multiplying the first and second reference values by a value, which is obtained by subtracting the second color coordinate from the first color coordinate.

13. The method of claim 12, further comprising:

gamma-compensating the image signals to output the gamma-compensated image signals as the first image signals; and performing a reverse gamma compensation on the third image signals and the white image signal to output the reverse gamma compensated third and white image signals.

14. The method of claim 12, wherein the first reference value is set by dividing a minimum value among data values of the image signals by a maximum value among the data values of the image signals or by dividing a minimum value among data values of the first image signals by a maximum value among the data values of the first image signals.

15. The method of claim 12, wherein the second reference value is set to a value between 0 and 1, and the white image signal is set by multiplying a minimum value among data values of the first image signals by the second reference value.

16. The method of claim 15, wherein data values of the second image signals are set by subtracting a data value of the white image signal from the data values of the first image signals.

* * * * *